United States Patent [19]

Citterio

[11] Patent Number: 4,702,426

[45] Date of Patent: Oct. 27, 1987

[54] SCREENLESS SCREW MILL

[75] Inventor: Paolo Citterio, Milan, Italy

[73] Assignee: Maistore S.p.A., Bergamo, Italy

[21] Appl. No.: 848,858

[22] Filed: Apr. 7, 1986

Related U.S. Application Data

[63] Continuation of Ser. No. 582,544, Feb. 22, 1984, abandoned.

[30] Foreign Application Priority Data

Mar. 21, 1983 [IT] Italy ..... 20176 A/83

[51] Int. Cl.[4] ..... B02C 13/28

[52] U.S. Cl. ..... 241/167; 241/188 R; 241/260.1; 241/294

[58] Field of Search ..... 241/293, 294, 295, 188 R, 241/260, 261, 260.1, 166, 167, 236, 191, 195, 189 R, 192, 194, 197

[56] References Cited

U.S. PATENT DOCUMENTS

| | | | |
|---|---|---|---|
| 39,835 | 9/1863 | Reece | 241/295 |
| 223,689 | 1/1880 | Adams | 241/260.1 |
| 1,490,368 | 4/1924 | Elzemeyer . | |
| 1,540,908 | 6/1925 | Shelton | 241/188 R X |
| 2,153,590 | 4/1939 | Rietz . | |
| 2,273,405 | 2/1942 | Hoehn | 241/188 R X |
| 2,785,865 | 3/1957 | Berling . | |
| 2,840,356 | 6/1958 | Wills | 241/295 X |
| 3,082,962 | 3/1963 | Parten . | |
| 3,579,717 | 5/1971 | Middlebrooks | 241/188 R X |
| 3,887,141 | 6/1975 | Francis | 241/195 X |
| 3,917,179 | 11/1975 | Graf | 241/195 X |
| 3,966,126 | 6/1976 | Werner | 241/188 R X |
| 3,968,998 | 7/1976 | Wolf | 241/260.1 X |
| 3,996,126 | 12/1976 | Rasmussen . | |
| 4,029,263 | 6/1977 | Wilkinson et al. | 241/188 R |
| 4,408,725 | 10/1983 | Wenger et al. | 241/260.1 |

FOREIGN PATENT DOCUMENTS

| | | | |
|---|---|---|---|
| 83174 | 3/1957 | Denmark | 241/188 R |
| 674114 | 5/1939 | Fed. Rep. of Germany . | |
| 1185460 | 1/1965 | Fed. Rep. of Germany . | |
| 1231094 | 12/1966 | Fed. Rep. of Germany . | |
| 2016302 | 9/1979 | United Kingdom . | |
| 1558423 | 1/1980 | United Kingdom | 241/236 |

*Primary Examiner*—Mack Rosenbaum

*Attorney, Agent, or Firm*—Stevens, Davis, Miller & Mosher

[57] ABSTRACT

A screenless mill which grinds and simultaneously conveys material utilizes a grinding system constituted by a rotating shaft on which grinding elements are fixed in a helical arrangement. The helical arrangement forms a screw which facilitates the advancement of the material in addition to grinding it. The screw pitch is adjustable in such a manner that when the material reaches the discharge port it has attained the required particle size. The grinding elements are readily interchangeable to permit replacement of worn or damaged parts or to treat a variety of materials as well as to vary the degree of grinding to be attained.

6 Claims, 25 Drawing Figures

SCREENLESS SCREW MILL

This application is a continuation of application Ser. No. 582,544, filed Feb. 22, 1984 and now abandoned.

This invention relates to a universal mill of new concept. More precisely, the invention relates to a mill comprising grinding elements disposed in a helical pattern on a shaft rotating centrally in a cylinder, of which the inner surface creates the necessary reaction to said grinding elements.

The mill operates without a screen, and simultaneously grinds and advances the material. It is also a "universal" mill in the sense that its facility for adaption is such that it can be used for grinding any type of material originating from industry or agriculture.

A considerable number of industrial mills are currently available commercially, these being classified in the following categories according to the type of grinding element:

fixed or mobile hammer mills
fixed or mobile knife mills
roller mills
grindstone mills All these mills exert a grinding but not an advancing action on the material, the ground material being in all cases sieved through a screen which selects its particle size, and is an integral part of the mill itself. Moreover, none of the currently known mills can be defined as "universal" in the aforesaid sense. In particular, they all have to a greater or lesser degree the limitation of not being suitable for grinding agricultural products with a moisture content exceeding 15%. This is because this type of material tends to aggregate and to adhere to the screen, so obstructing it and preventing further discharge of the ground material.

The friction of the grinding elements against the undischarged product leads to local overheating which can reach the autocombustion state. In any case, the grinding process becomes blocked, and considerable mill maintenance problems arise.

As stated, the mill according to the present invention can be used for grinding any type of material, but is particularly useful for grinding moist agricultural products, even with a moisture content considerably greater than 15%, such as cereals or fibrous cellulose materials intended for animal foods.

This extremely advantageous result has been attained by dispensing with the screen, which is responsible for blocking mills of known type when used for grinding moist materials. The elimination of the screen has itself been made possible by designing a grinding system of absolutely new concept.

The characteristics of the new mill be more apparent with reference to the accompanying drawings, which diagrammatically illustrate some specific embodiments thereof.

Equal elements are indicated by the same reference numerals in the figures.

Figure 1:
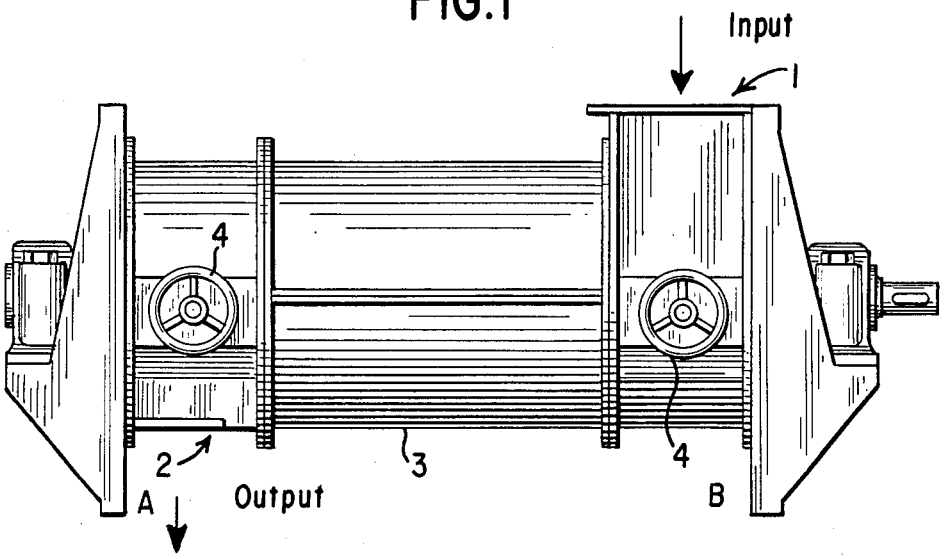
FIG. 1 is a side view of the mill.
Figure 2:
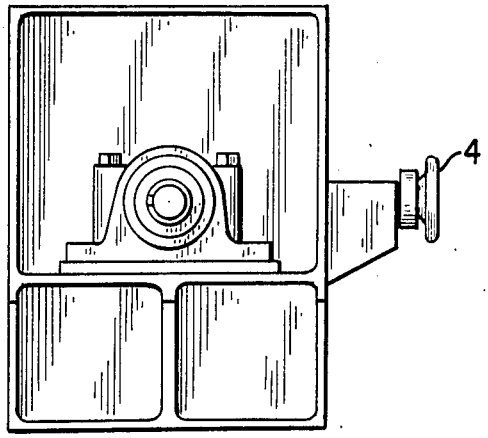
FIG. 2 is a front view thereof.

With reference to FIGS. 1 to 10, 21 and 22, the new mill according to the invention is constituted essentially by an outer cylinder 3, a feed port 1 for the material, to be ground, a discharge port 2 for the ground material, and a shaft 10 rotating concentrically to the longitudinal axis of the cylinder and driven by a variable speed motor.

The rotating shaft can be of circular, square or polygonal cross-section. Grinding elements are mounted along said shaft in a helical pattern in such a manner as to form a screw for advancing the material between the feed port and discharge port.

The inner surface 6 of the cylinder 3 is at such a distance from the grinding elements as to cooperate with them in order to develop the friction action necessary for grinding. In a preferred embodiment shown in FIGS. 3, 5, 7, 9 and 21, the inner surface 6 of the cylinder 3 is provided with helical fluting which cooperates with the grinding elements (also disposed helically on the shaft) both for grinding and for conveying the material. However, depending on the material to be treated, it can be advantageous to provide the inner surface of the cylinder with fluting or ribs parallel to the axis of rotation, or with projecting parts, for example in the form of diamond points, or indeed to leave it completely smooth or also provide it with little holes suitable to eliminate the powdered materials formed at the very beginning of the grinding operation. The mill cylinder inner surface defined in this manner extends over the entire length of the cylinder between the points A and B of FIG. 1, and comprises a lead-in portion at the point diametrically opposite the feed port.

The central part of the cylinder 3 is preferably constructed as two semi-cylindrical parts which are assembled or hinged along two diametrically opposing middle generating lines, so that they can be opened apart in order to enable the internals to be replaced by slidable parts having a differently structured surface and thus of different grinding efficiency or to vary within narrow limits the diameter of the cylinder 3 and also to allow easy access to the central shaft and grinding members for their maintenance or replacement.

At the initial and terminal part of the mill in positions corresponding respectively with the feed port 1 and discharge port 2 there are provided two comb devices 37 which can be operated from the outside by means of advancement devices which adjust their depth of penetration through the mill walls.

Figure 19:
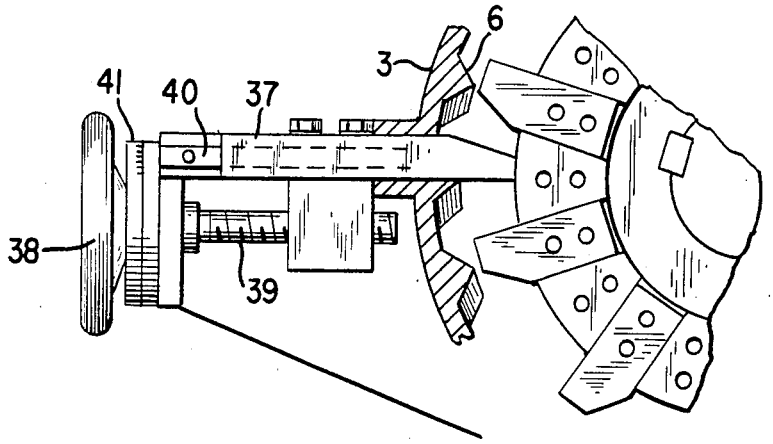
FIG. 19 is a detail of the side view of a comb device.
Figure 20:
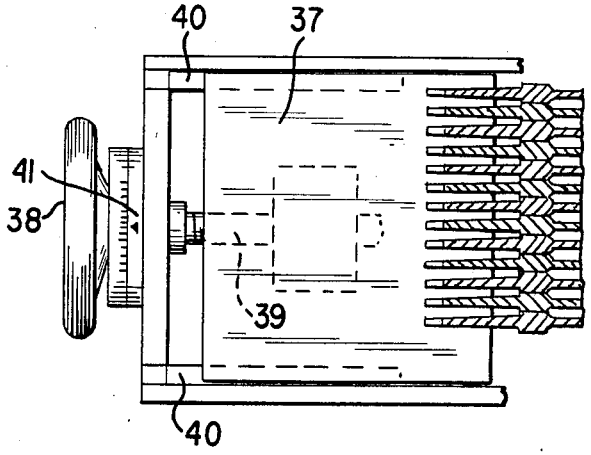
FIG. 20 is a plan view of the same device, cooperating by way of example with the grinding elements of FIG. 4.
Figure 21:
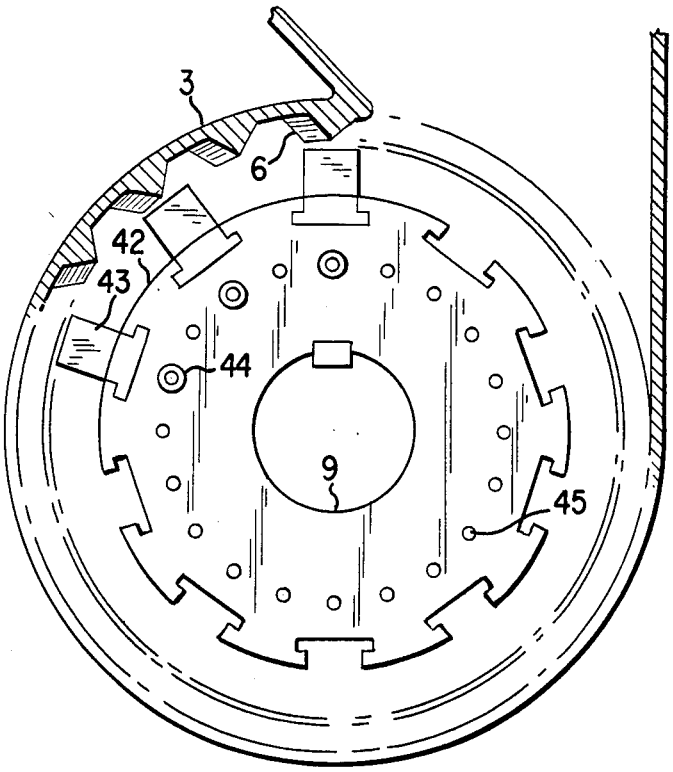
FIG. 21 is a cross-section through the initial part of the mill at the level of the feed port; a particular grinding element different from the preceding is visible.
Figure 22:
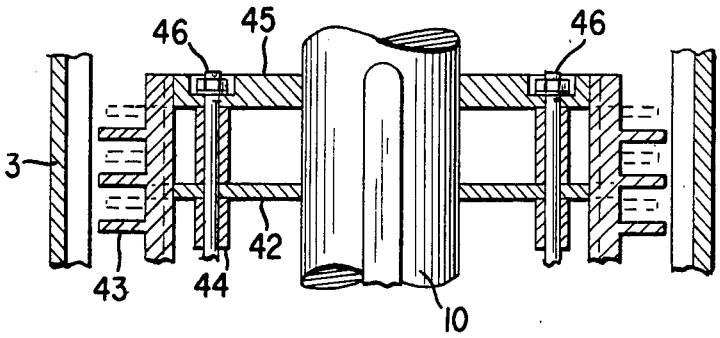
FIG. 22 is a partial inner side view of the mill of FIG. 21.
Figure 23:
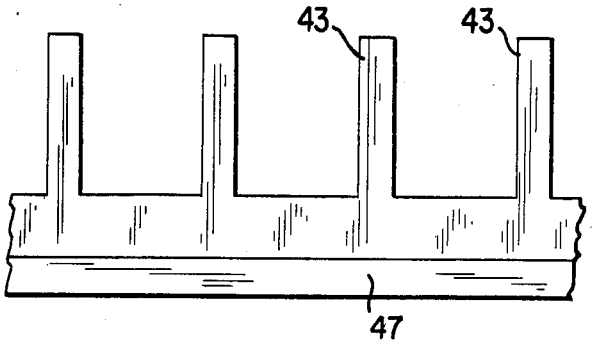
FIGS. 23, 24, 25 are three orthogonal projections showings the bar which carries the grinding elements of the mill of FIGS. 21 and 22.
Figure 24:
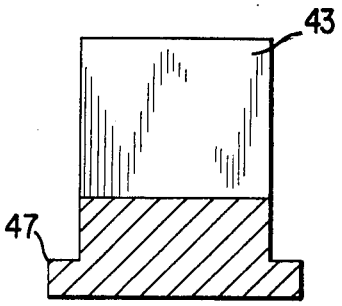
Figure 25:
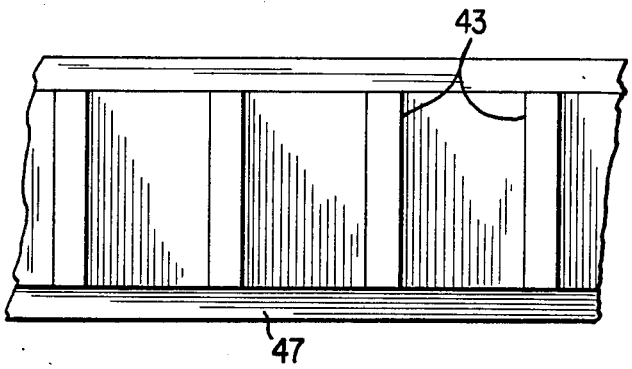

One of these devices is visible in FIGS. 19 and 20. In the example illustrated, the comb 37 is made to slide forwards or backwards on guides 40 by means of feed screws 39 controlled from the outside of the mill by the handwheel 38.

In the illustrated example, it is apparent that the comb structure has a profile which is conjugate with the profile of the grinding elements, between which it is completely inserted and from which it is completely disengaged when the advancement device is in its two respective end positions. The purpose of the comb device or "refiner" provided in the initial part of the mill is to coarsely crush the fed material when the device is suitably positioned relative to the grinding elements. The purpose of the comb device of "refiner" provided in the terminal part of the mill is to further refine and homogenise the final particle size of the ground material, and to totally remove the ground material tending to adhere to the last grinding elements. Because of their different purposes, the position of the comb relative to the grinding elements is generally different in the case of the initial refiner and final refiner respectively.

As stated, the grinding elements which constitute one of the characteristics of the new mill according to the invention can be constructed in various alternative embodiments, all of which are equivalent from the point of view of the inventive concept, but which are specifically suitable and particularly advantageous for different materials to be treated. This gives the new mill a versatility which cannot be attained with other known systems, and is one of the reasons for the aforesaid "universality".

Figure 3:
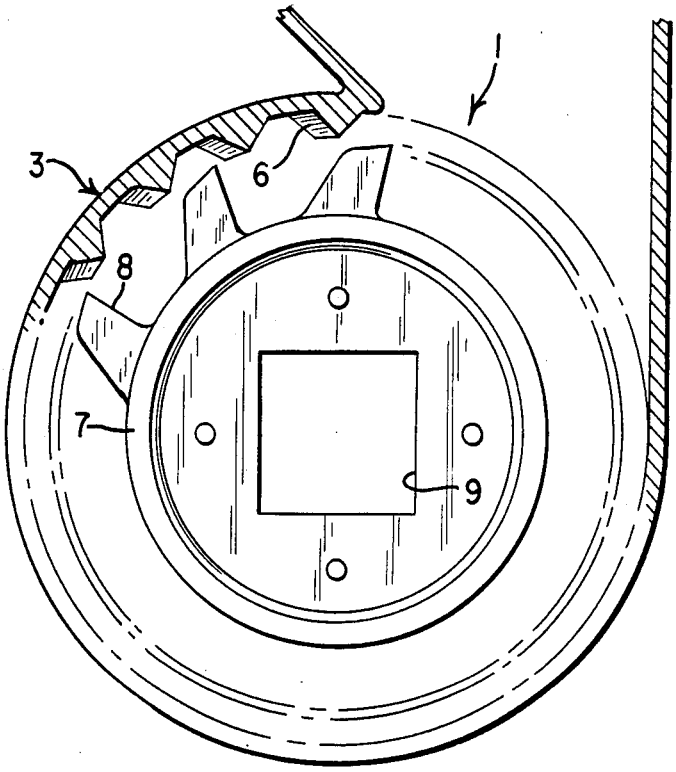
FIG. 3 is a cross-section through the intial part of the mill at the level of the feed port; a particular grinding element according to the invention is visible.
Figure 4:
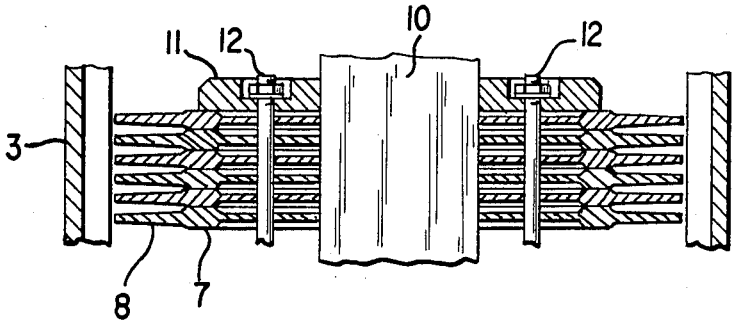
FIG. 4 is a partial internal side view of the mill of FIG. 3.

One embodiment of the grinding elements is visible in FIGS. 3 and 4. In this embodiment, the grinding elements are in the form of a single cast piece which in addition to the actual grinding element 8 comprises the disc 7 for its mounting on the rotating shaft. Said disc 7 centrally comprises an aperture 9 of shape corresponding to the cross-section through said rotating shaft, on which the discs can be mounted by sliding them on and then fixed by suitable screws which pass through the holes provided in the disc.

When the stack of discs has been mounted on the shaft it is fixed thereto against two terminal discs 11 by means of nuts 12.

Figure 5:
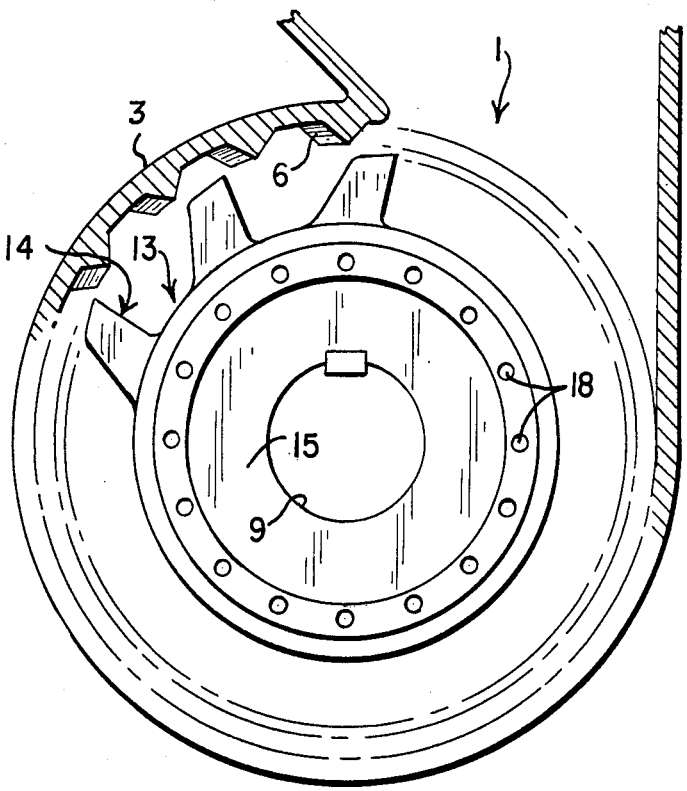
FIG. 5 is a cross-section through the initial part of the mill at the level of the feed port; a particular grinding element according to the invention, but different from that of FIG. 3, is visible.
Figure 6:
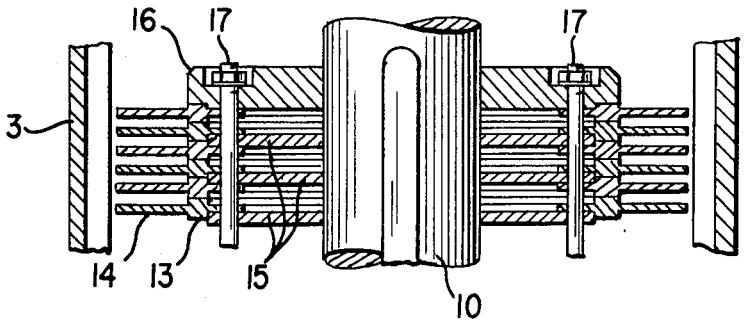
FIG. 6 is a partial inner side view of the mill of FIG. 5.

In a further embodiment illustrated in FIGS. 5 and 6, the mounting discs and grinding elements are in the form of separate parts to be assembled directly on the rotating shaft. In the particular embodiment illustrated, the discs 15 have a central aperture 9 corresponding to the cross-section through the shaft, and holes 18 along their edge to allow the passage of fixing screws. At their base, the grinding elements 14 have a particular T configuration 13 which allows two adjacent elements to be inserted into one fixing disc.

The T-shaped base is also provided with through holes corresponding to those provided in the edge of the fixing discs, to allow passage of the screws which lock the stack of grinding elements to the terminal discs 16 of the rotating shaft by means of the nuts 17.

Figure 7:
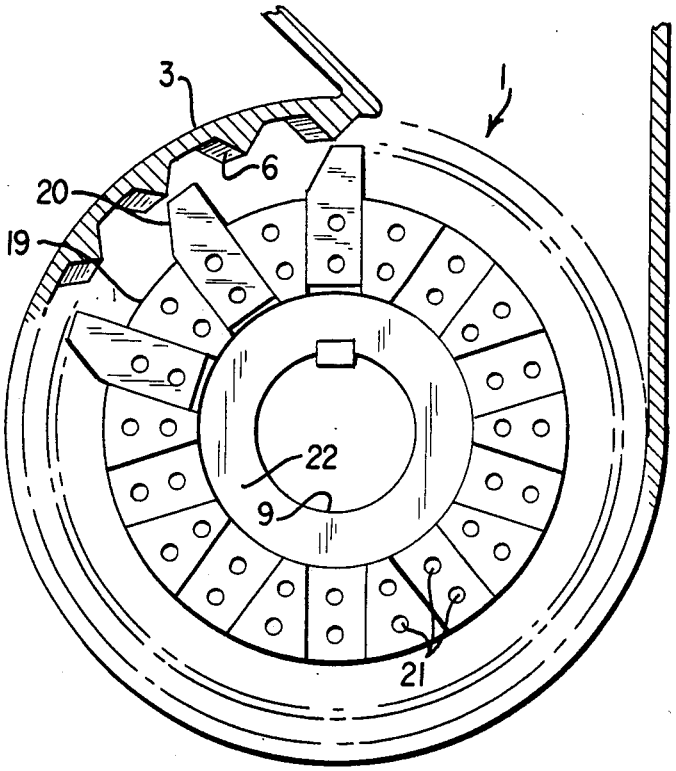
FIG. 7 is a cross-section through the initial part of the mill at the level of the feed port; a particular grinding element according to the invention, but different from the preceding, is visible.
Figure 8:
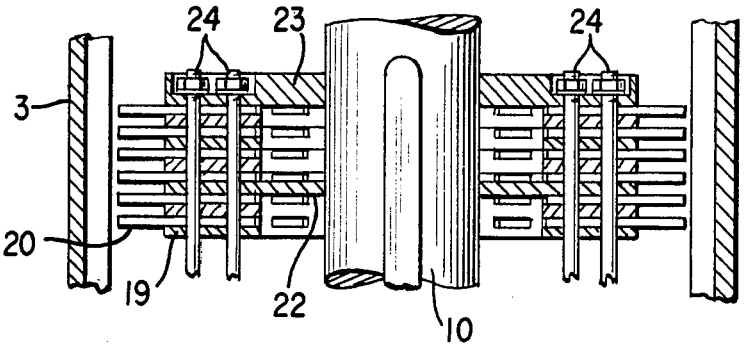
FIG. 8 is a partial inner side view of the mill of FIG. 7.

In a further embodiment illustrated in FIGS. 7 and 8, the mounting discs 22 are again separate from the grinding elements 20. These latter are mounted on support rings 19 provided in their edges with notches corresponding to the cross-section of the grinding elements which are to be inserted into them. In the illustrated example, the grinding elements, the support rings and the mounting discs are provided with two corresponding through holes 21 which allow passage of two screws for locking the stack of grinding elements and fixing it to the plates 23 of the shaft 10 by means of nuts 24.

Spacer rings are also provided, their purpose being to space the grinding elements apart in accordance with a predetermined diagram as described hereinafter.

Figure 9:
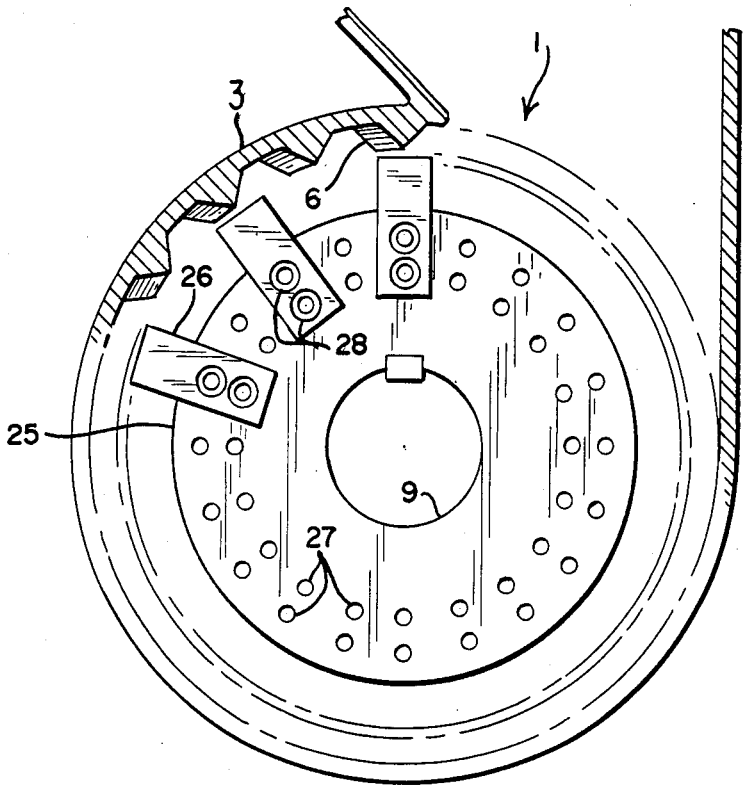
FIG. 9 is a cross-section through the initial part of the mill at the level of the feed port; a particular grinding element different from the preceding is visible.
Figure 10:
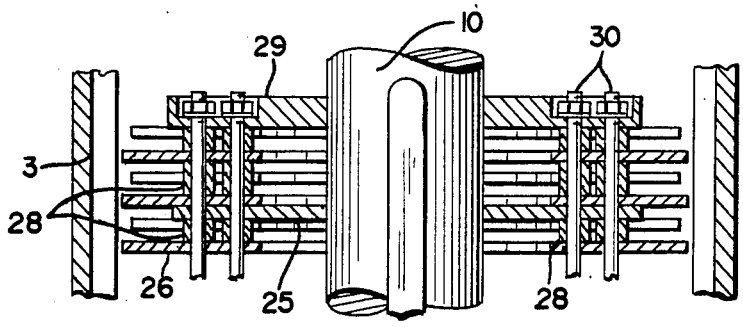
FIG. 10 is a partial inner side view of the mill of FIG. 9.

In a further embodiment illustrated in FIGS. 9 and 10, the mounting discs 25 are again separate from the grinding elements 26.

However, in this case the grinding elements are assembled on the mounting discs by means of bushes 28 which space them apart, to simultaneously form a structure or grid which is particularly useful for certain materials. Two corresponding through holes are again provided in the grinding elements and fixing discs to enable the grinding elements to be locked on to the fixing discs 29 and these locked on to the rotating shaft 10 by means of through screws and relative nuts 30.

In a further embodiment illustrated in FIGS. 21–25, the mounting discs are separate from the grinding elements, which form an integral part of bars of any length, in particular of a length equal to the length of the mill cylinder. In the illustrated example, the bars, which are formed in one piece by casting, comprise a base part 47 of T cross-section such as to allow them to be tightly inserted into the fixing rings, and also comprise the actual grinding elements 43 suitably spaced apart on the bars. The fixing discs 42 comprise recesses in their edges which are exactly conjugate with the T-shaped base part of the bars, which are inserted into them.

The discs for fixing them on to the shaft also comprise corresponding through holes 44 which enable the disc-bar assembly to be locked by through screws and nuts 46. Spacer rings 42 without recesses in their edges can also be mounted along the shaft, for the purpose of supporting the bars and uniformly distributing their weight along the shaft 10.

As stated, the grinding systems shown diagramatically in FIGS. 2, 3, 4, 5, 6, 7, 8, 9, 10, 21, 22, 23, 24 and 25 are purely illustrative, and a larger number of other forms and alternative systems are possible.

In all cases, the essential requirement is to provide a shaft cross-section and a conjugate central aperture in the fixing discs of such a shape as to allow the grinding elements to be located along said shaft in the manner of a helix in order to form a screw having a predetermined pitch in accordance with the characteristics of the material to be ground.

The through holes which serve for assembling the discs, the grinding elements and any spacer elements on the shaft must also obviously be provided.

In the particular case of the grinding elements provided on bars, the screw is obtained either by using bars with equally spaced-apart grinding elements and mounting them in a suitably staggered arrangement, or by using bars with grinding elements spaced differently apart.

Figure 15:
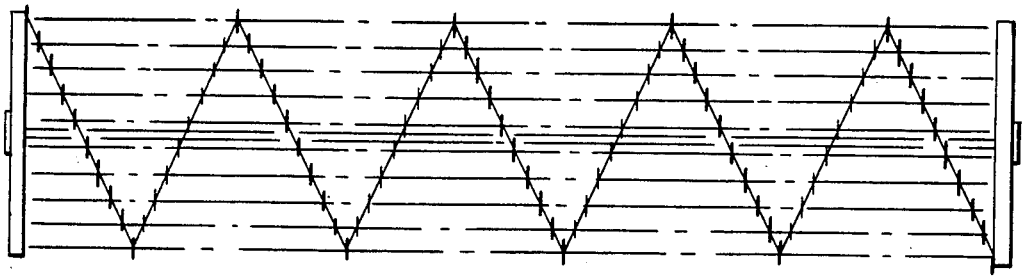
FIGS. 15 is a side view of the rotating shaft with a particular arrangement of grinding elements in the form of a screw around it.
Figure 16:
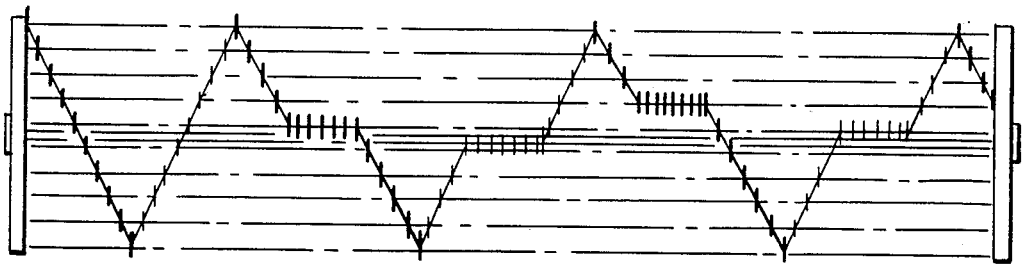
FIG. 16 is a side view of the rotating shaft with a different arangement of grinding elements forming a screw around it.
Figure 17:
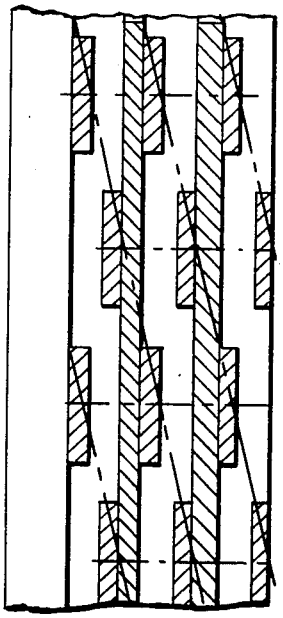
FIG. 17 is a diagrammatic representation of the pattern of the screw formed by the grinding elements of FIGS. 7 and 8.
Figure 18:
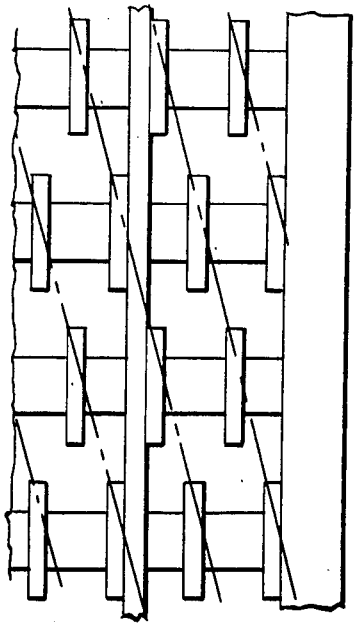
FIG. 18 is a diagrammatic representation of the pattern of the screw formed by the grinding elements of FIGS. 9 and 10.

The arrangement which the grinding elements assume along the rotating shaft of the mill can be seen for example in FIG. 17, in the case of the particular embodiment of FIGS. 7 and 8, and in FIG. 18 in the case of the embodiment of FIGS. 9 and 10. FIG. 15 and 16 diagrammatically show further possible distributions of the grinding elements along the shaft.

The grinding power of the mill is the resultant of the speed of rotation of the shaft and of the frequency of the grinding elements.

The speed of advancement of the ground material depends essentially on the pattern of the screw formed by the grinding elements, said advancement being practically zero in those portions in which the grinding elements are moutned parallel to each other in a corresponding position which does not vary along a helix.

Figure 11:
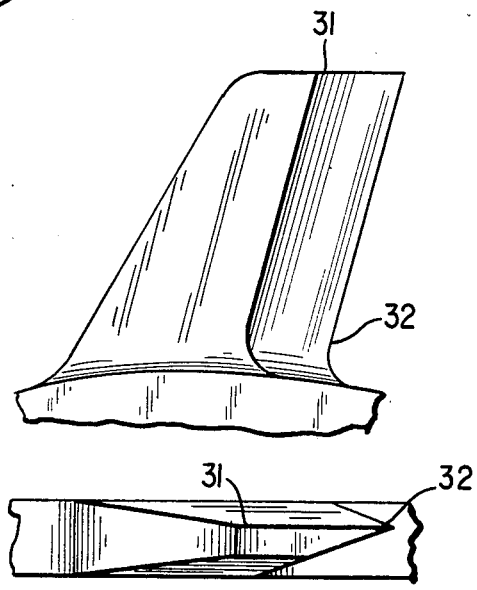
FIGS. 11, 12, 13, 14 show some grinding elements in detail.
Figure 12:
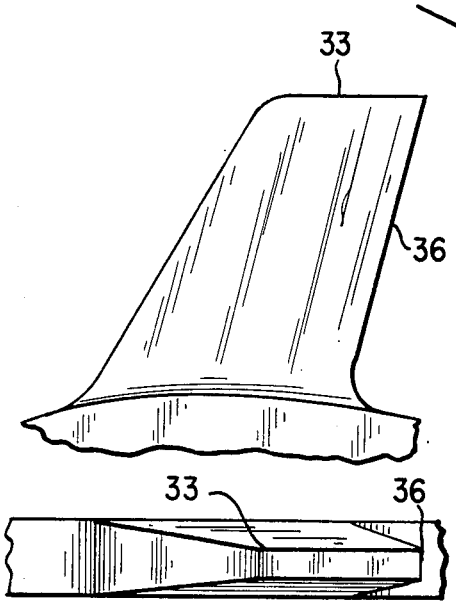

The type of grinding action provided by the mill also depends on the type of grinding element and can be varied by varying this latter. Essentially, these elements can be of the hammer or knife type, and each of these types can be provided in various forms. By way of example, FIG. 11 shows a knife element 31 with its blade 32 and FIG. 12 a hammer element 33 with its working edge 36, these elements being of the type forming an integral part of the fixing disc. the elements could also form part of the grinding bars in a similar manner.

Figure 13:
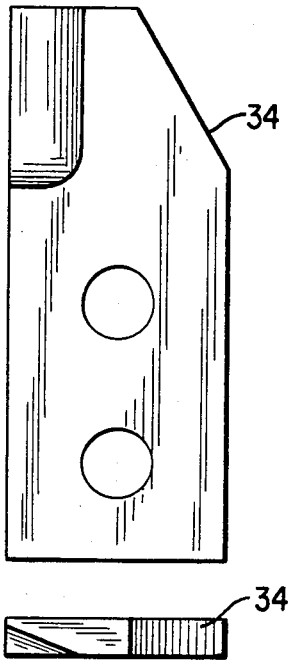
Figure 14:
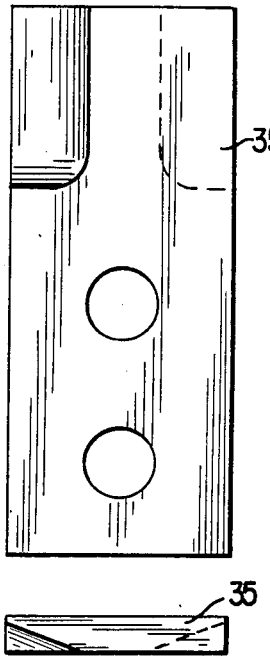

FIG. 13 shows a knife element 34 of the type for fixing on a support ring, and FIG. 14 shows a different knife element 35 also of the type for fixing on a support ring. The knife edge can be provided either on one side of the element or on both sides as shown for example by the dashed line in FIG. 14. Cutting elements of this type can also be formed by forging operations on discs or on grinding bars produced by casting as a single piece.

Summarising, the aspects which characterise the new mill are as follows:

it operates without a screen and is therefore not subject to clogging; the ability to dispense with the screen is a result of the new grinding system, which ensures particle size uniformity of the ground product conveyed to the discharge port a grinding and advancement system constituted by a shaft rotating at variable speed and by grinding elements arranged along its surface in a helical distriubtion to form a screw which cooperates with the inner cylindrical surface of the mill. The system has five variables, namely the shaft speed, the type of grinding elements, the direction of the cutting element, the pitch of the screw formed by the grinding elements, and the shape of the inner cylinder surface which cooperates with the grinding elements.

Different combinations of these five variables, which can be adjusted at will, result in grinding systems of different power and characteristics, which are specifically suitable for each type of material, even with a moisture content much greater than 15% an advanceable comb device cooperating with the grinding elements in the initial part of the mill in order to provide preliminary crushing of the material to be ground; this device can be adjusted from the outside, and by varying the degree of advancement, a variously effective crushing system is obtained which is specifically suitable for each type of material treated.

an advanceable comb device cooperating with the grinding elements in the terminal part of the mill in order to further refine and homogenise the particle size of the ground product. This device is substantially analogous to the preceding, but because of its different purpose it is adjusted independently and generally in a different manner.

All the parts of the grinding and advancement system are easily removeable and replaceable, and in particular the shaft, the fixing discs, the grinding elements of any form in which they are provided, the spacer elements and the inner lining of the cylinder.

Thus the same mill can be modified as required for use in different processes, by being fitted with different parts.

All these elements are constructed of suitable metals or metal alloys, and generally of stainless steel.

The versatility of the new mill and the practically unlimited modifications which can be made thereto will be immediately apparent to the expert of the art, all such possible modifications falling within the scope of the invention and covered by the present patent.

I claim:

1. A screenless mill for grinding material comprising a hollow cylinder, end walls on said cylinder to close the same except for a feed port and a discharge port, a shaft mounted for rotation centrally within said hollow cylinder, a plurality of fixing discs carried by said shaft so as to be rotated thereby, and grinding elements rigidly secured to the peripheries of said fixing discs in a plurality of circumferentially arranged recesses, said grinding elements and said discs being mounted on said shaft with the grinding elements arranged in a helical pattern thus forming a screw, said grinding elements cooperating with said hollow cylinder so as to grind material therebetween upon rotation of said shaft, whereby simultaneously with the grinding between the grinding elements and said cylinder the material is caused to advance from the feed port to the discharge port, and wherein the grinding elements are arranged on carrying bars in groups with rectilinear alignment, each group forming an integral single piece with the carrying bar, the base part of the carrying bars being of a configuration suitable to enable them to be axially inserted into said circumferentially arranged recesses on said fixing discs, said recesses being of a configuration corresponding to the base part of the carrying bars, and said bars being parallel to the rotating shaft.

2. A mill as claimed in claim 1, wherein the rotating shaft can be of circular or polygonal cross-section.

3. A mill as claimed in claim 1, wherein the grinding elements are spaced apart by suitable spacer elements which enable the pitch of the grinding screw to be adjusted along the mill axis in a predetermined manner.

4. A mill as claimed in claim 1, wherein the inner wall of the cylinder comprised fluting formed by ribs which are parallel to the mill axis.

5. A mill as claimed in claim 1, comprising in its initial part, in a position corresponding with the feed port, a comb device which is connected to an advancement device and cooperates with the grinding element in such a manner as to cause initial crushing of the material to be ground.

6. A mill as claimed in claim 1, comprising in its terminal part, in a position corresponding with the discharge port, a comb device which is connected to an advancement device and cooperates with the grinding elements in such a manner as to refine the particle size of the ground product and to remove any material adhering to the last grinding elements.

* * * * *